United States Patent [19]

Poteet

[11] Patent Number: 4,853,280

[45] Date of Patent: Aug. 1, 1989

[54] RELEASABLE POLYURETHANE BACKED TEXTILES

[75] Inventor: William C. Poteet, Dalton, Ga.

[73] Assignee: The Dow Chemical Company, Midland, Mich.

[21] Appl. No.: 931,500

[22] Filed: Nov. 17, 1986

[51] Int. Cl.[4] ..... B32B 27/00

[52] U.S. Cl. ..... 428/286; 428/85; 428/105; 428/109; 428/246; 428/247; 428/284; 428/297; 428/298; 428/300; 428/317.3; 428/340; 428/343; 428/354

[58] Field of Search ..... 428/317.3, 284, 286, 428/300, 246, 247, 95, 423.1, 297, 298, 40, 105, 109, 85, 343, 354, 340

[56] References Cited

U.S. PATENT DOCUMENTS

| | | | |
|---|---|---|---|
| 3,704,197 | 11/1972 | Bahlo | 161/67 |
| 3,728,182 | 4/1973 | Wisotzky et al. | 156/72 |
| 3,871,948 | 3/1975 | Norris | 156/148 |
| 3,928,281 | 12/1975 | Uchigaki | 260/42.39 |
| 4,010,301 | 3/1977 | Anderson et al. | 428/95 |
| 4,010,302 | 3/1977 | Anderson et al. | 428/95 |
| 4,039,709 | 8/1977 | Newman | 428/40 |
| 4,122,224 | 10/1978 | Brewer et al. | 428/195 |
| 4,210,693 | 7/1980 | Regan et al. | 428/152 |
| 4,278,482 | 7/1981 | Poteet | 428/95 |
| 4,307,145 | 12/1981 | Goldman | 428/354 |
| 4,469,740 | 9/1984 | Bailly | 428/300 |
| 4,484,574 | 11/1984 | De Rusha et al. | 428/40 |
| 4,515,844 | 5/1985 | Coughlin | 428/300 |
| 4,554,194 | 11/1985 | Haas et al. | 428/40 |

*Primary Examiner*—James J. Bell

[57] ABSTRACT

This invention is a floor covering which may be easily removed from its underlying surface and which resists buckling or folding when rolled, comprising:

(a) a facing layer;

(b) a bottommost release backing layer which comprises a nonwoven fabric of relatively short fibers or continuous filament fibers, and (c) a polymer layer which is bonded to the release backing layer on one side and directly or indirectly to the facing layer on the other side.

In another aspect, this invention is an improvement in a process for preparing a polymer-backed floor covering, which process comprises applying a layer of an uncured polymer-forming composition to one side of a textile and curing said composition to form a polymer backing attached to said textile, the improvement which comprises applying a layer of a non-woven fabric of relatively short fibers or continuous filament fibers to the polymer backing before said polymer-forming composition is cured to a tack-free state.

7 Claims, 2 Drawing Sheets

RELEASABLE POLYURETHANE BACKED TEXTILES

BACKGROUND OF THE INVENTION

This invention relates to release backing layers which may be formed on polymer-backed floor covering to allow carpet or carpet padding to be easily removed from its underlying surface, yet which resists buckling or folding when such carpet is rolled.

Manufacturing methods have been devised and improved for producing, polymer-backed floor covering, particularly polyurethane foam-backed carpets.

One previously unsolved problem in connection with polymer-backed floor covering and particularly in connection with polyurethane foam-backed carpet however, relates to installation. When it was necessary to remove a glued down polymer backed carpet, the installer was faced with significant cost and effort. Typically, where multipurpose adhesives were used, the bond between the bottom of the polymer backing and the underlying surface would be sufficiently strong to cause the carpet to delaminate or the polymer backing to separate as the carpet was being pulled up, and thus to leave a residue of adhesive and portions of the polymer backing on the floor. This residue would have to be mechanically removed by scraping or vibrating, resulting in significant additional cost. Often, these costs exceed the entire cost of replacing and installing the new carpet.

Such removal problems were to some extent alleviated with the advent of pressure sensitive adhesives, which in theory never fully harden, so that carpet may be applied, removed and reapplied repeatedly. However, due to the lack of internal strength in most polyurethane foam carpet cushions, portions of the polyurethane foam cushion would remain bonded to the floor even when these pressure releasable adhesives were used. Time-consuming, expensive removal was therefrom required.

The significance of this problem is demonstrated by the prevalence of an alternative method of securing carpeting by the use of tack strips. In the tack strip method, wooden strips are secured to the floor or underlying surface around the perimeter of the room. Padding is then placed on the surface and carpet is stretched over the padding and tacked to the strips. Removal of tacked down carpet leaves no residual adhesive or polymer backings. The tack strip method, however, requires skilled and trained installers and is expensive.

These preexisting installation methods illustrate the desirability of a polymer-backed carpet which can be glued to the floor using a pressure sensitive adhesive and removed some time later by simply pulling the carpet from the floor, leaving the adhesive layer in a tacky state ready for installation of the next carpet. Such a method allows installers to change home carpeting using minimum time and effort. In the contract carpet market, removal and installation costs are significantly lower.

One proposed solution to the foregoing problem is to bond a release backing layer to the underside of such carpet. The release backing layer may then be glued to the floor. When such a carpet is pulled from the floor, the release backing layer provides the carpet with sufficient mechanical strength to remain substantially intact.

However, the addition of such a release backing to a carpet has been found to cause additional stiffness. One may particularly notice the effects of such stiffness when a polymer-backed carpet having a stiff secondary backing layer is rolled for storage. Heretofore, when such carpet was rolled toward the secondary backing, the secondary backing was unable to absorb the compressive forces placed on it by being rolled inside of the primary backing layer, and therefore buckled or folded. Such buckling and folding caused indentations in the polymer backing and facing layers of the carpeting, which remain visible in the carpet long after it is installed.

SUMMARY OF THE INVENTION

The present invention provides polymer-backed floor covering which can be pulled from the floor where adhesives have been used, and is easily replaced, but which resists buckling and folding when rolled. This invention is a floor covering which may be easily removed from its underlying surface and which resists buckling or folding when rolled, comprising:

(a) a facing layer;

(b) a bottommost release backing layer which comprises a nonwoven fabric of relatively short fibers or continuous filament fibers, and (c) a polymer layer which is bonded to the release backing layer on one side and directly or indirectly to the facing layer on the other side.

In another aspect, this invention is an improvement in a process for preparing a polymer-backed floor covering, which process comprises applying a layer of an uncured polymer-forming composition to one side of a textile and curing said composition to form a polymer backing attached to said textile, the improvement which comprises applying a layer of a non-woven fabric to the polymer backing before said polymer-forming composition is cured to a tack-free state.

This invention is useful in the preparation of both carpet and carpet padding, as well as other floor covering. In the case of carpet padding, the polymer backing and release backing layers may be applied to both sides of the facing material if desired. Further, laminated carpet padding may be formed by repeatedly applying a polymer layer and an additional flexible facing layer according to the present invention, and then applying a release backing layer to the final polymer backing layer. Laminated carpet backing may also be so formed.

The release backing layer of the present invention increases internal strength of the bottom side of the floor covering. Accordingly, the floor covering of this invention has much superior ability to resist tearing and delamination when removed from an installation in which it has been glued down. The floor covering exhibits improved ease of removal using when all types of adhesives are used. However, less expense will be incurred and the advantages of easy removal and subsequent re-installation without the need to apply a new adhesive layer will be more effectively realized by use of "permanent tack", or pressure sensitive adhesives.

DETAILED DESCRIPTION OF THE INVENTION

Figure 1:
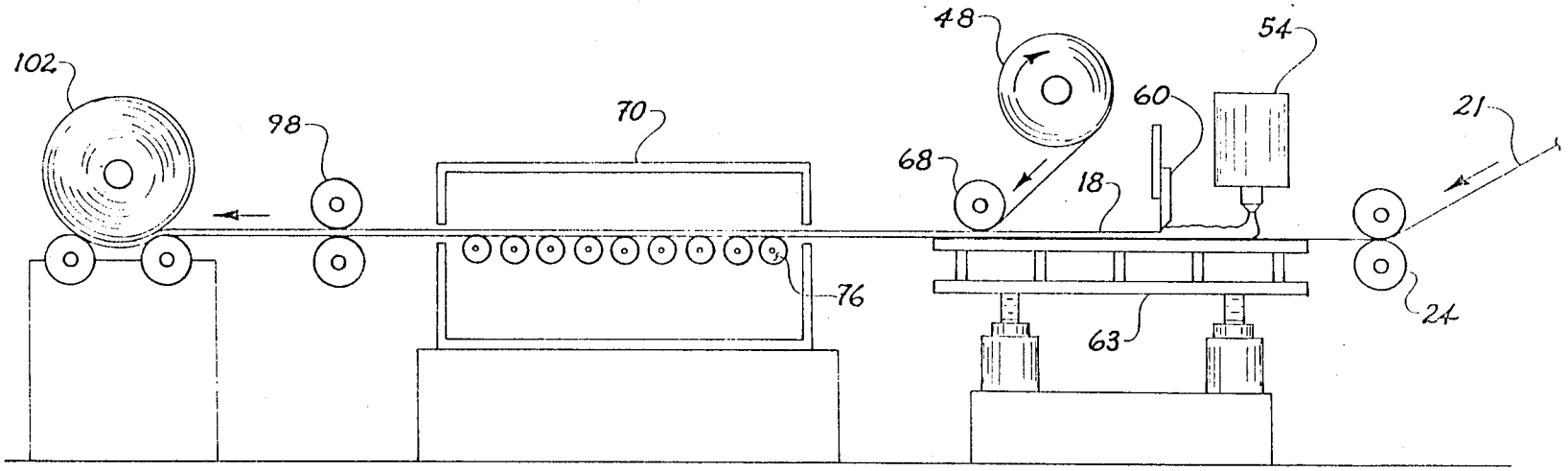
FIG. 1 is a side schematic view of a line for manufacturing floor covering according to the present invention.

FIG. 1 shows a floor covering line coater utilized according to the present invention. A facing layer 21 is fed onto a metering plate 63, upon which a polymer layer 18 and a bottommost release backing layer 48 are laminated to the facing layer 21.

The facing layer can be of any desirable construction and composition. Although referred to herein for convenience as a "facing layer", this layer is not necessarily visible in the finished floor covering. Such facing layer may comprise, for example, a woven or tufted carpet of natural or synthetic materials with or without a precoat or secondary backing, or a woven or nonwoven scrim, a polymeric sheet material or like material. A flexible facing material such as is commonly employed in manufacturing carpet padding is also suitable. Such flexible facing is advantageously a non-woven material because it evenly disperses stresses and has few existing internal stresses, so that buckling, bubbling and wrinkling over a period of time is reduced. A woven or non-woven flexible facing may be needle-punched to reduce internal stresses and strains. The facing layer advantageously has a weight of about 2 to about 20, preferably about 8–40, ounces/square yard.

Although not shown, the facing layer may, if desired, be stored in an input accumulator which may be in the form of a conventional J-box. The facing layer 21 may also be optionally be treated with heat and/or steam prior to lamination to the polymer and release backing layers. Such treatment is advantageously performed using a steam box or steam can as is conventional in the art (not shown). The heat or steam treatment helps eliminate surface irregularities from the facing layer 21 and preheats it prior to application of the polyurethane layer 18.

In the embodiment illustrated, the facing layer 21 is advanced over the metering plate 63 using pulling rollers 24. Alternatively, a tenter frame or similar means for pulling the facing layer 21 through the various processing zones without substantial distortion can be used in place of or in conjunction with the pulling rollers 24. Tensioning rollers (not shown) can also be used to maintain a constant, desirable tension on the facing layer 21 as it is processed.

In FIG. 1, a layer 18 of a polymer forming composition is deposited onto facing layer 21 on metering plate 63 using a mixing head 54. The composition of the polymer-forming composition is not especially critical as long as the polymer-forming composition is a fluid mixture which subsequently cures or coalesces to form a flexible, non-fluid polymer. Suitable polymer-forming compositions include latexes such as aqueous styrene/-butadiene dispersions, polyurethane-forming compositions and the like. Preferably, the polymer-forming composition forms a cellular polymer when cured or coalasced.

Preferably, the polymer layer 18 is a mechanically blown polyurethane foam layer. Suitable compositions for forming such mechanically blown polyurethane foam layer, and methods for applying same to a facing layer by means of a frothing mixer-generator or head 54 are taught in U.S. Pat. Nos. 3,821,130 to Barron, et al. and 4,296,159 to Jenkines, et al. both of which are incorporated herein by reference. According to this method, the frothing is accomplished by mechanically inducing an inert gas, preferably relatively moisture-free air, into the polyurethane composition. This may be accomplished, for example, by feeding a stream comprising a mixture of urethane forming components or separate streams of urethane-forming components and a stream of air or other inert gas into a suitable froth generator such as an Oakes foamer, continuing mixing in a static or Kenics mixer, and connecting the mixer to a hose whose free end is made to cyclically traverse the moving facing layer 21 to apply the polyurethane foam layer 18. Similarly, the inert gas and the urethane forming components except for the catalyst may be fed to the foamer or generator and the catalyst subsequently mixed with the resultant froth prior to being applied to facing layer 21. The froth density of the urethane composition is controlled by controlling the amount of gas introduced during frothing.

In FIG. 1, a release backing layer 48 is then applied to the surface of the uncured polymer forming composition layer 18 using a marriage roller 68 or other appropriate means. The release backing layer 48 comprises a non-woven fabric of relatively short fibers or continuous filament fibers, and may be of natural or synthetic fibers. Non-wovens made of polymeric fibers such as polyester or polypropylene are the preferred fabrics for release backing of the present invention, and they preferably are needle-punched, spun bonded or stitch bonded for improved mechanical bonding to the polyurethane foam layer. Most preferred nonwoven fabrics are those made of polymeric fibers having an average length of about 3/16 to about 12, more preferably about 2 to about 8 inches, which are needle-punched to provide improved mechanical strength. Fabric weights for the release backing layer may range from about 0.9 ounce to 24 ounces per square yard, although a weight of between 2 and 10 ounces per square yard is preferred. It is also desirable in some applications to calendar one or both sides of the release backing fabric in order to reduce the tendency to bond to the underlying surface. In addition, the release backing fabric, may be precoated with a sealant such as a latex or a polyurethane sealant, if desired.

Alternatively, a one-shot chemically blown foam layer may be applied by supplying such foam components to a mixing head such as is conventional in the art, for application to the facing layer 21. The application of such a chemically blown polyurethane foam layer to carpet facing is disclosed, for instance, in Tillotson U.S. Pat. No. 4,405,393, which is incorporated herein by reference.

After the polyurethane foam layer 18 has been applied to either the facing layer 21 or the backing layer 48, its thickness may be adjusted by means known to those skilled in the carpet coating art with a doctoring means such as a doctor blade 60 or air knife 62 and metering plate 63. The blade 60 or knife 62, which are advantageously of the types generally known in the art, is preferably adjustable in position to vary the thickness of the polymer layer 18. The doctor knife 60 may be wrapped or covered with a suitable releasable film such as polyethylene and/or rotated to remove any gelled or cured polymer or to reduce the formation thereof. An air knife 62 is advantageous because it does not become clogged or jammed with buildup in the presence of a fast-curing polymer-forming composition as a doctor blade 60 does; instead, a curtain of high pressure air emitted by the air knife 62 continually ensures that a polymer layer 18 of proper uniform thickness passes under air knife 62.

As shown in FIG. 1, a metering plate 63 may be used to support facing layer 21 as the doctor blade 60 or air knife 62 adjusts the thickness of the polymer layer 18. The metering plate 63, in a preferred embodiment, has hollow portions to allow the flow of air for cooling or heating purposes and is adjustable in height.

The coated and backed facing layer 21 is then passed through oven 70 to effect full or partial curing of the polymer-forming composition layer 18. The release backing layer 48 is preferably, but need not be, applied to the polyurethane foam layer 18 prior to curing. The release backing layer may be simply laid down onto the polymer-forming composition, or applied by means of a marriage roller, a doctor blade or by other means. If desired, the release backing layer 48 may be applied to the polymer layer 18 after it is partially cured, but prior to the gel point of the composition.

Before or after the release backing layer 48 has been applied to the polymer layer 18, the floor covering may be regauged such as described in U.S. Pat. No. 4,278,482 to Poteet, et al., which is incorporated herein by reference. According to this process, the partially cured polyurethane foam layer 18 is regauged or pressed to a new precise and highly uniform thickness by means of a regauging roller.

After the floor covering has been cured, it may then be advanced through a selvage edge trimmer 98 and to an accumulator 102 or rollup area.

Figure 2:
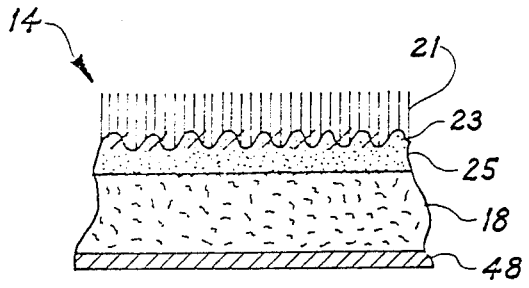
FIG. 2 is a side schematic view of one embodiment of carpet according to the present invention.
Figure 3:
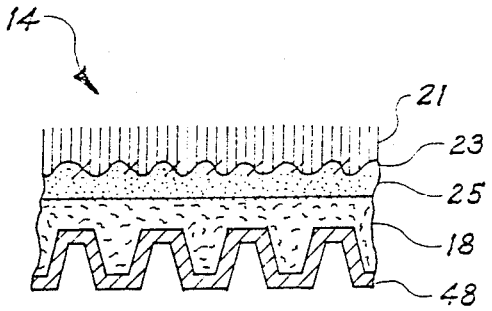
FIG. 3 is a side schematic view of carpet according to the present invention having a regauged bottom surface.

FIGS. 2–7 show embodiments of a floor covering 14 or 16 manufactured according to the present invention. FIG. 2 illustrates one embodiment of a floor covering 14 comprising a facing layer 21 with a primary backing 23. Precoat layer 25 is optional. A polyurethane foam layer 18 is bonded to the precoat layer 25 or primary backing 23, and the release backing layer 48 is bonded to the polyurethane foam layer 18. FIG. 3 shows such a carpet which has been regauged in accordance with a preferred embodiment.

Figure 4:
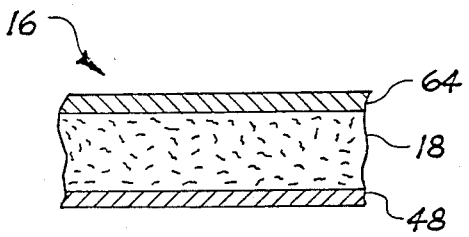
FIG. 4 is a side schematic view of one embodiment of carpet padding according to the present invention.
Figure 5:
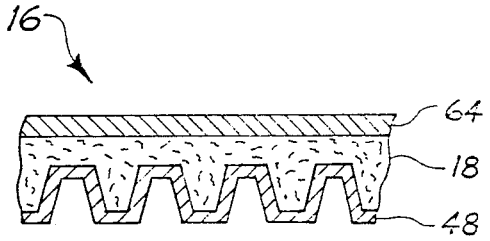
FIG. 5 is a side schematic view of carpet padding according to the present invention having a regauged bottom layer.

FIG. 4 shows a carpet padding 16 comprising a scrim layer 64 such as is conventional in the art, in combination with a polyurethane foam layer 18 and a release backing layer 48. FIG. 5 shows such a padding regauged in accordance with a preferred embodiment.

Figure 6:
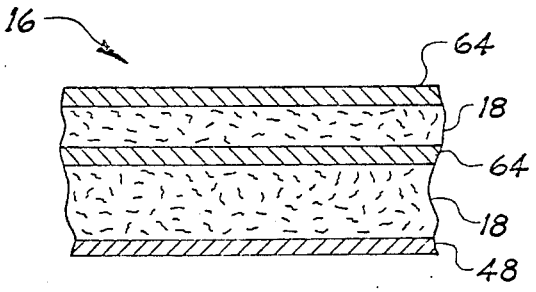
FIG. 6 is a side schematic view of laminated floor covering according to the present invention.

FIG. 6 shows a laminated carpet padding 16 according to the present invention comprising two scrim or facing layers 64, two polyurethane foam layers 18 and a release backing layer 48. The upper facing layer 64 may instead be a release backing layer 48, or have physical properties similar to the release backing layer 48 for easy removal of carpet from padding 16. Such a laminated padding 16 may be manufactured, for example, by passing the first scrim layer 64 twice through the coating machinery of the present invention, each pass adding a polyurethane foam layer 18 and a scrim layer 64 or release backing layer 48.

Figure 7:
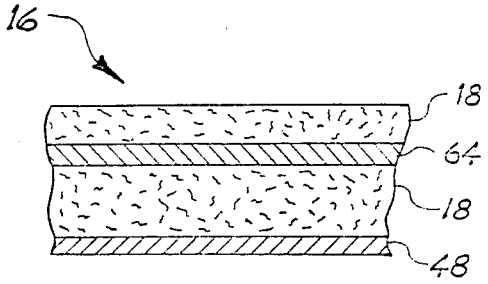
FIG. 7 is a side schematic view of an additional embodiment of laminated floor covering according to the present invention.

FIG. 7 shows a laminated carpet padding 16 comprising two polyurethane foam layers 18, a facing layer 64 separating the foam layers, and a release backing layer 48. This padding may be manufactured by coating the facing layer 64 according to the present invention, turning it over, coating it again with a second polyurethane foam layer 18 and applying a release backing layer 48. The laminated padding 16 may be regauged in accordance with the present invention. Further, the carpet 14 (FIG. 2) may be repeatedly coated with polyurethane foam layers 18 and facing layer 64 to form laminated polyurethane foam cushioned carpet, and such carpet may be regauged in accordance with the present invention.

The floor covering of the present invention may be applied to its underlying surface with conventional adhesives or pressure sensitive, permanent tack adhesives. The latter are preferable because they decrease the possibility of delamination of the floor covering, and allow the installer to more easily remove and replace carpet without the necessity of removing the adhesive layer and applying another adhesive layer. Such adhesives are well known and may be used for carpet installation in accordance with manufacturers' instructions and recommendations.

As mentioned before, the advantages of this invention are most particularly seen when the polymer backing layer is a polyurethane foam, since these backings are particularly susceptible to tearing and delamination when removed from a glue down installation. Polyurethane foam layers are also preferred due to their general physical properties, including tenuous bonding to the primary backing (often expressed as a high tuft lock), good dimensional stability and its ability to provide good cushioning to the carpet. Suitable polyurethane foam formulations are described, for example, in U.S. Pat. Nos. 3,821.130, 3,862,879, 4,296,159, 4,336,089, 4,397,978, 4,435,459, 4,483,894 and 4,525,405, all incorporated herein by reference.

The following examples are intended to illustrate the present invention, but are not intended to limit the present invention in any manner. All parts and percentages are by weight unless otherwise indicated.

EXAMPLE 1

In a suitable container are thoroughly blended 100 parts of a 90:10 mixture of a 4800 molecular weight ethylene oxide-capped poly(propylene oxide) triol and ethylene glycol, 50 parts aluminum trihydrate and 60 parts calcium carbonate. Care is taken during mixing to exclude water. After mixing, the blend is cooled to about 72° F.

About 210 parts of this blend is mixed with 0.08 part of a catalyst, 0.15 parts of a 10% silicone surfactant solution in the polyol blend described above, and 40 parts of a 27.5% NCO prepolymer prepared by reacting toluene diisocyanate with a mixture of a 200 molecular weight poly(ethylene oxide) diol and 255 molecular weight poly(propylene oxide) triol. This blend is fed to an Oakes foamer in order to froth the material, using air as the gas.

The frothed blend is combined with 0.1 part of a 10% organotin catalyst solution in the polyol blend described above, and 0.28 part of water preblended in 0.85 part of an 1800 molecular weight poly(propylene oxide diol which is subsequently end-capped with ethylene oxide to a final molecular weight of about 2000. The resulting froth has a density of about 0.3 g/cc.

The froth is applied to the back side of a carpet having a polypropylene facing weighing 8 ounces per square yard. The carpet is first passed over a steam chest to 'bloom' the yarn, and then heated to about 300° F. on a heated drum. The froth is then deposited as a puddle on the back of the carpet, which is then passed under a doctor blade which shapes the froth into a layer of uniform 0.125" thickness. The coating weight is about 23.5 ounces per square yard.

After the carpet passes the doctor knife, a non-woven polyester scrim (Style No. 2117, from Hoechst Fibers) is placed onto the surface of the uncured froth. This scrim is composed of randomly oriented 6–8" fibers which have been needle punched to increase strength. The resulting sandwich structure is heated at about 250°–275° F. until the froth is substantially cured. The coated carpet is trimmed to a width of 12 feet and subsequently rolled up to a length of 100 feet. The carpet rolls up smoothly without buckling or folding. The foam layer of the coated carpet has a density of 11 pounds per cubic foot, and a compression set of 8.5%.

The coated carpet is installed in an office area using a pressure sensitive (permanent tack) adhesive. The adhesive is spread over the floor at a thickness of about 5–20 mils and allowed to dry. The carpet is then placed over the adhesive. Repeated removals of the carpet from the adhesive do not significantly damage the polyurethane backing, and repeated installation of the carpet provides a secure bond to the floor.

EXAMPLE 2

A froth is prepared as described in Example 1, except the froth density is about 0.44 g/cc. This froth is applied- as described in example 1 to a layer of a needle punched woven polypropylene fabric having an approximate weight of 4.5 ounces per square yard. The woven polypropylene is previously passed over a drum which is heated to about 212° F. A froth layer about 0.25 inch thick is applied to the fabric. The froth layer weighs about 38.5 ounces per square yard.

A nonwoven polyester scrim as described in Example 1 is placed onto the surface of the uncured froth, and the froth is cured as described in Example 1. The resulting carpet padding is trimmed to a 12 foot width, further cut into two 6-foot widths and rolled up. No buckling or folding is seen on roll up.

The carpet padding is installed with the nonwoven scrim down in an office area, using a 5–20 mil layer of a pressure sensitive adhesive to secure it to the floor. A 5–20 mil layer of the pressure sensitive adhesive is then spread on the top side of the installed padding, and a carpet with a jute backing is laid over the padding. The carpet is easily removed and reinstalled over the padding, and the padding is easily removed and reinstalled without significant damage.

What is claimed is:

1. A floor covering which may be easily removed from its underlying surface and which resists buckling or folding when rolled, comprising:

(a) a facing layer having a weight of about 8–40 ounces/square yard;

(b) a bottommost release backing layer having a weight from about 0.9 to 24 ounces per square yard which comprises a nonwoven fabric or relatively short fibers or continuous filament fibers, and (c) a polymer layer which is bonded to the release backing layer on one side and directly or indirectly to the facing layer on the other side.

2. The floor covering of claim 1 wherein said release backing comprises a nonwoven fabric composed of randomly oriented polymeric fibers having an average length of about 3/16 to about 12 inches.

3. The floor covering of claim 1 wherein said nonwoven fabric is needle punched and said polymeric fibers have an average length of about 2 to about 8 inches.

4. The floor covering of claim 1 wherein said polymeric fibers comprise polypropylene or polyester fibers.

5. The floor covering of claim 2 wherein the outer surface of the release backing layer is calendared.

6. The floor covering of claim 2 wherein said polymer layer comprises a polyurethane foam.

7. The floor covering of claim 6 wherein the release backing and the polyurethane foam layer are regauged.

* * * * *

UNITED STATES PATENT AND TRADEMARK OFFICE

CERTIFICATE OF CORRECTION

PATENT NO. : 4,853,280

DATED : August 1, 1989

INVENTOR(S) : William C. Poteet

It is certified that error appears in the above-identified patent and that said Letters Patent is hereby corrected as shown below:

Column 1, line 12, "producing, polymer-backed" should correctly appear as --producing polymer-backed--;line 41, "therefrom" should correctly appear as --therefore--.

Column 3, line 43, "optionally be treated" should correctly appear as --optionally treated--.

Column 4, line 3, "coalasced" should correctly appear as --coalesced--.

Column 6, line 37, "3,821.130" should correctly appear as --3,821,130--.

Column 8, line 22, "fabric or relatively" should correctly appear as --fabric of relatively--.

Signed and Sealed this

Tenth Day of July, 1990

*Attest:*

HARRY F. MANBECK, JR.

*Attesting Officer*

*Commissioner of Patents and Trademarks*